US008382277B2

(12) United States Patent
Chinzei et al.

(10) Patent No.: US 8,382,277 B2
(45) Date of Patent: Feb. 26, 2013

(54) LAYERED STRUCTURE

(75) Inventors: Kiyoshi Chinzei, Daito (JP); Toshinori Asai, Daito (JP)

(73) Assignee: Seiko Epson Corporation, Tokyo (JP)

( * ) Notice: Subject to any disclaimer, the term of this patent is extended or adjusted under 35 U.S.C. 154(b) by 634 days.

(21) Appl. No.: 12/413,199

(22) Filed: Mar. 27, 2009

(65) Prior Publication Data

US 2009/0244249 A1 Oct. 1, 2009

(30) Foreign Application Priority Data

Mar. 27, 2008 (JP) ..... 2008-084947

(51) Int. Cl.
*B41J 29/13* (2006.01)

(52) U.S. Cl. ..... 347/108; 347/138

(58) Field of Classification Search ..... 347/108, 347/109, 101, 1, 138, 2, 103, 104, 3; 399/125, 399/110; 312/237; 353/119
See application file for complete search history.

(56) References Cited

U.S. PATENT DOCUMENTS

| | | | | |
|---|---|---|---|---|
| 5,298,917 | A | 3/1994 | Deguchi et al. | |
| 8,016,412 | B2 * | 9/2011 | Kawai et al. | 347/108 |
| 2006/0029424 | A1 * | 2/2006 | Kawai et al. | 399/125 |
| 2007/0002290 | A1 * | 1/2007 | Muraki et al. | 353/119 |
| 2007/0292159 | A1 * | 12/2007 | Iijima | 399/110 |
| 2008/0157639 | A1 * | 7/2008 | Jeong et al. | 312/237 |

FOREIGN PATENT DOCUMENTS

| | | | |
|---|---|---|---|
| JP | 05-048785 | A | 2/1993 |
| JP | 2001-125233 | A | 5/2001 |
| JP | 2005-345050 | A | 12/2005 |
| JP | 2006-044073 | A | 2/2006 |

* cited by examiner

*Primary Examiner* — Manish S Shah
(74) *Attorney, Agent, or Firm* — Sughrue Mion, PLLC

(57) ABSTRACT

A layered structure is provided with a recording unit, a reading unit whose back edge is connected to the recording unit via a pivot member, a support member having (i) a connecting portion that is connected pivotally to the reading unit, (ii) a contact portion that contacts a counterface surface of the recording unit facing the reading unit, and (iii) a support column that positions the contact portion at a position a certain distance from the connecting portion, a biased member that is biased against the support member in a forward direction, and a stopping portion formed on the counterface surface to stop the contact portion contacting the counterface surface from being displaced along the counterface surface.

7 Claims, 11 Drawing Sheets

LAYERED STRUCTURE

CROSS REFERENCE TO RELATED APPLICATION

This patent application claims priority based on a Japanese patent application, No. 2008-084947 filed on Mar. 27, 2008, the contents of which are incorporated herein by reference.

BACKGROUND

1. Technical Field

The present invention relates to a layered structure. More specifically, the present invention relates to a layered structure including a lower structure and an upper structure joined to the lower structure via a pivot member, and functioning to hold up a portion of the upper structure with the pivot member as an axis.

2. Related Art

A known image reading/recording apparatus is provided with a reading unit and a recording unit in a layered state, for example. This type of apparatus is sometimes configured such that the reading unit provided on the upper portion serves as a cover for the recording unit provided on the lower portion.

In other words, when accessing the inside of the recording apparatus, e.g. when replacing the ink cartridge of the recording unit or removing a recording medium that is jammed in the feeding path, the scanner serving as the cover is lifted to expose the inside of the recording unit. When opening a reading unit that serves as such a cover, the reading unit is desirably held in the lifted state while a user replaces the ink cartridge or the like on the inside.

When closing the opened reading unit serving as the cover, the reading unit desirably does not freely drop to the closed state, since the scanner is high-precision machinery and not merely a cover. Therefore, when closing the reading unit, a mechanism is provided to decrease the speed of the fall or to stop the reading unit momentarily in the middle of the fall.

JP-A-2001-125233 discloses a structure provided with a rail mechanism that guides the upper ends of a series of stays that support the movable cover of the photo processing apparatus, and an avoidance mechanism that is provided on the rail mechanism to guide the upper ends of the stays to take a different path when moving backward than when moving forward. With this structure, when closing the cover, the cover is momentarily held at the mid-point of the lowering, to prevent the cover from being closed too quickly.

JP-A-2005-345050 discloses a structure that decreases the closing speed of a large cooking range cover. This prevents a large and heavy cooking range cover from falling too quickly.

JP-A-2006-044073 discloses a structure provided with a linking member having a guide groove with a portion curved for a lid having a pin. With this structure, when closing the lid, the closing can be stopped or slowed.

As described above, a mechanism is desired that can slow the opening or closing of a lid or cover, particularly the closing. The various mechanisms described above, however, have complicated configurations with many components, resulting in problems such as a lack of durability and high cost. Furthermore, shock absorbing mechanisms using elastic bodies or liquids, such as a gas damper, have expensive components and gradually lose their effectiveness with repeated use.

SUMMARY

Therefore, it is an object of an aspect of the innovations herein to provide a layered structure, which is capable of overcoming the above drawbacks accompanying the related art. The above and other objects can be achieved by combinations described in the independent claims. The dependent claims define further advantageous and exemplary combinations of the innovations herein.

According to a first aspect related to the innovations herein, one exemplary layered apparatus may comprise a lower structure; an upper structure joined to the lower structure via a pivot member; a support member having (i) a connecting portion that is connected pivotally to the upper structure, (ii) a contact portion that contacts a counterface surface of the lower structure facing the upper structure, and (iii) a support column that positions the contact portion at a position a certain distance from the connecting portion; a biased member that biases the support member in a forward direction with the connecting portion as an axis; and a stopping portion that is provided on the counterface surface and stops the contact portion that contacts the counterface surface from being displaced in a forward direction along the counterface surface. A front edge of the upper structure is held at a certain distance from the lower structure.

The summary clause does not necessarily describe all necessary features of the embodiments of the present invention. The present invention may also be a sub-combination of the features described above. The above and other features and advantages of the present invention will become more apparent from the following description of the embodiments taken in conjunction with the accompanying drawings.

DESCRIPTION OF EXEMPLARY EMBODIMENTS

Hereinafter, an embodiment of the present invention will be described. The embodiment does not limit the invention according to the claims, and all the combinations of the features described in the embodiment are not necessarily essential to means provided by aspects of the invention.

Figure 1:
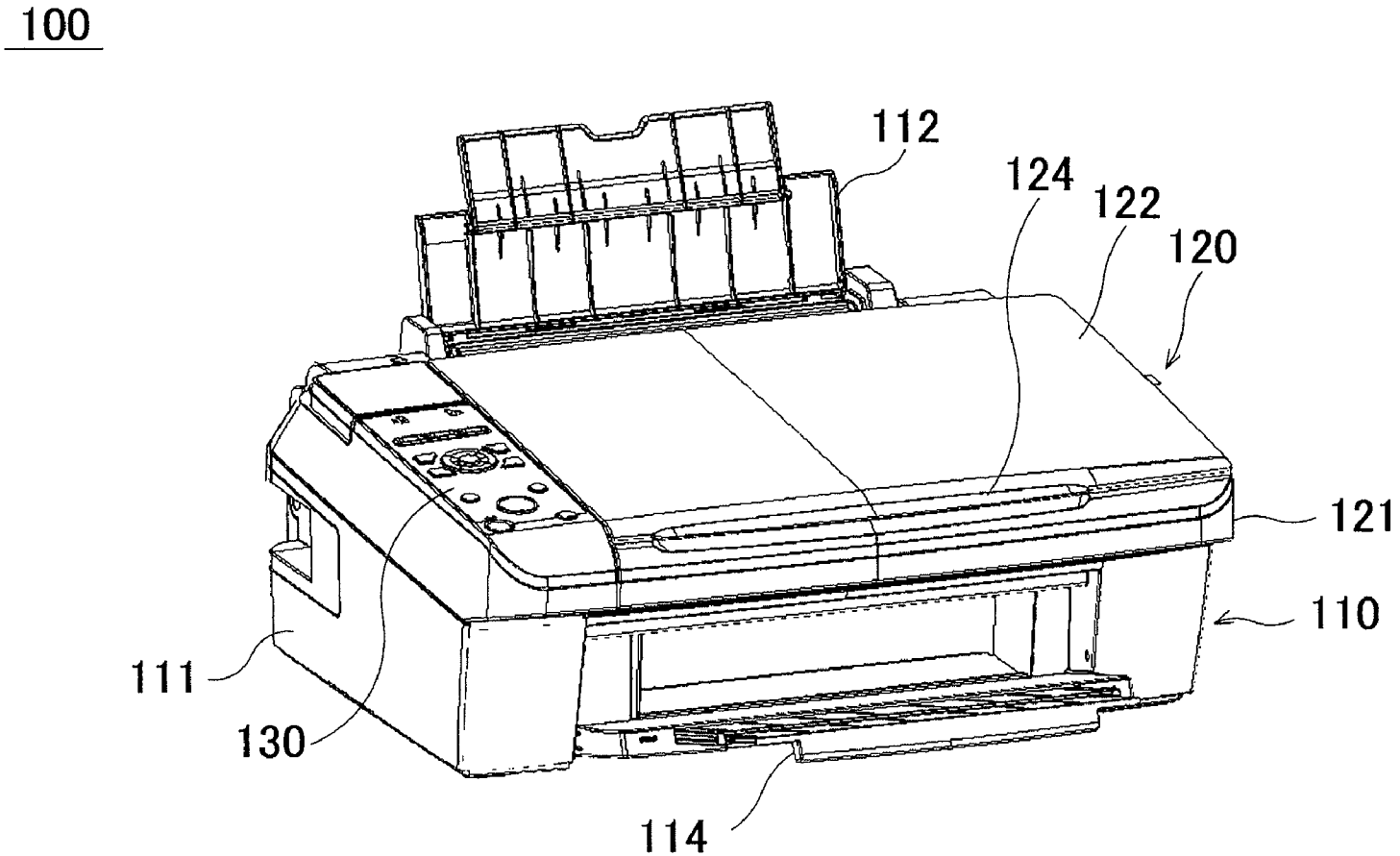
FIG. 1 is a perspective view of the image reading/recording apparatus 100.

FIG. 1 is a perspective view of the outside of an image reading/recording apparatus 100 including a reading unit 120. The image reading/recording apparatus 100 is formed by layering a recording unit 110 and the reading unit 120.

The recording unit 110 includes a lower chassis 111 with a substantially cubic shape, a paper support 112 attached to the back of the lower chassis 111, and a delivery tray 114 attached to the front of the lower chassis 111. The recording unit 110 acquires one piece at a time of the recording paper loaded on the paper support 112, and sends the recording paper to the delivery tray 114 after an image is recorded on the recording paper.

The reading unit 120 includes an upper chassis 121 having a relatively thin cubic shape, a document pressing section 122 that covers the top of the upper chassis 121, and an operation panel 130 positioned to one side of the document pressing section 122. The document pressing section 122 can be lifted from the upper chassis 121 by pressing a handle 124 formed on the front edge of the document pressing section 122. The operation panel 130 has a display section and a plurality of switches, and serves as an interface for independently operating the image reading/recording apparatus 100.

Figure 2:
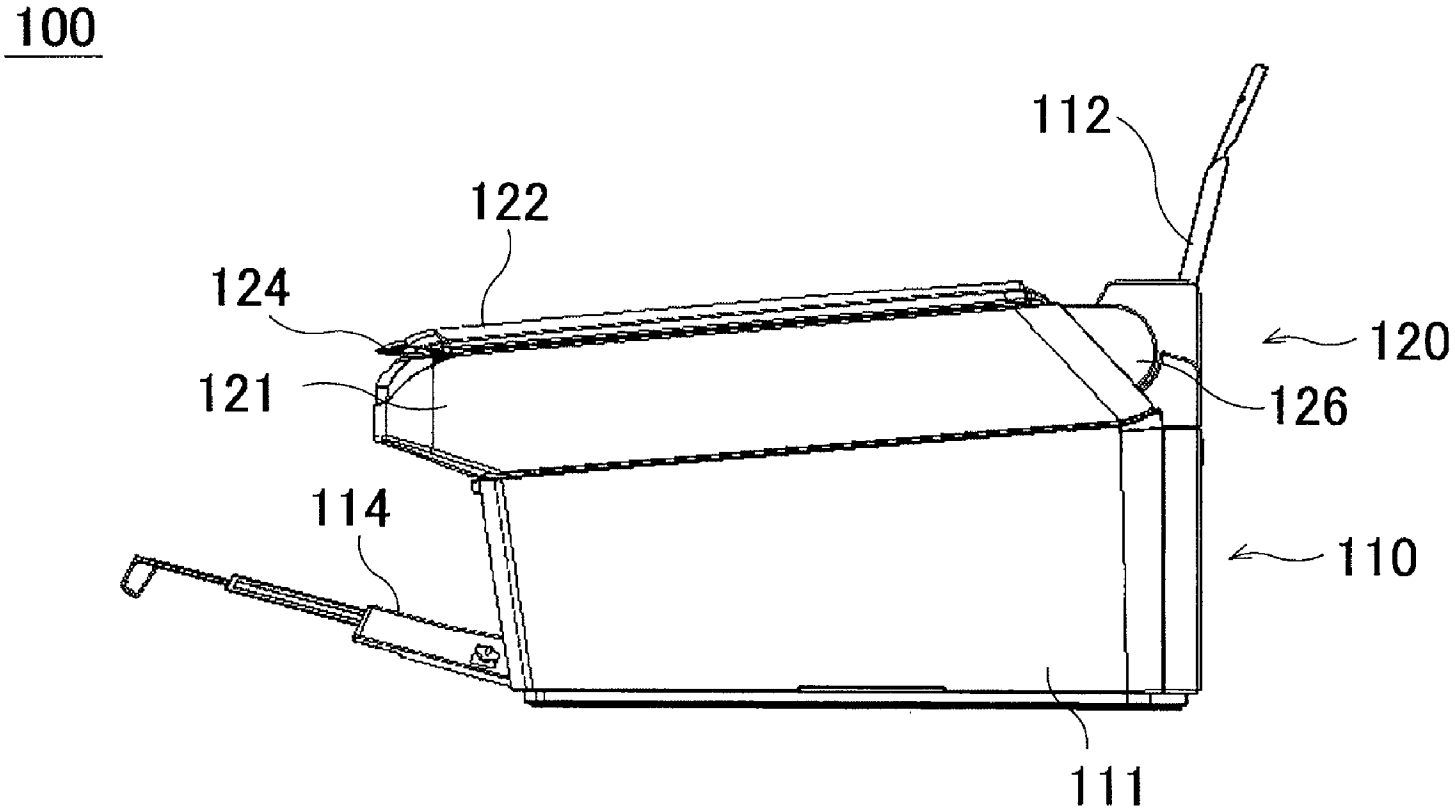
FIG. 2 is a lateral view of the image reading/recording apparatus 100.

FIG. 2 is a lateral view of the image reading/recording apparatus 100 shown in FIG. 1 as seen from the side. Components that are the same as those in FIG. 1 are given the same reference numerals and descriptions thereof are omitted.

The back edge of the upper chassis 121 is joined to the lower chassis 111 by the pivot member 126, such that the front edge of the entire reading unit 120 can be lifted. In this way, maintenance can be performed inside the recording unit 110 by lifting the reading unit 120 to expose the inside of the lower chassis 111 of the recording unit 110. Here, "performing maintenance" may include replacing a consumable such as an ink cartridge, removing jammed recording paper, or the like.

Figure 3:
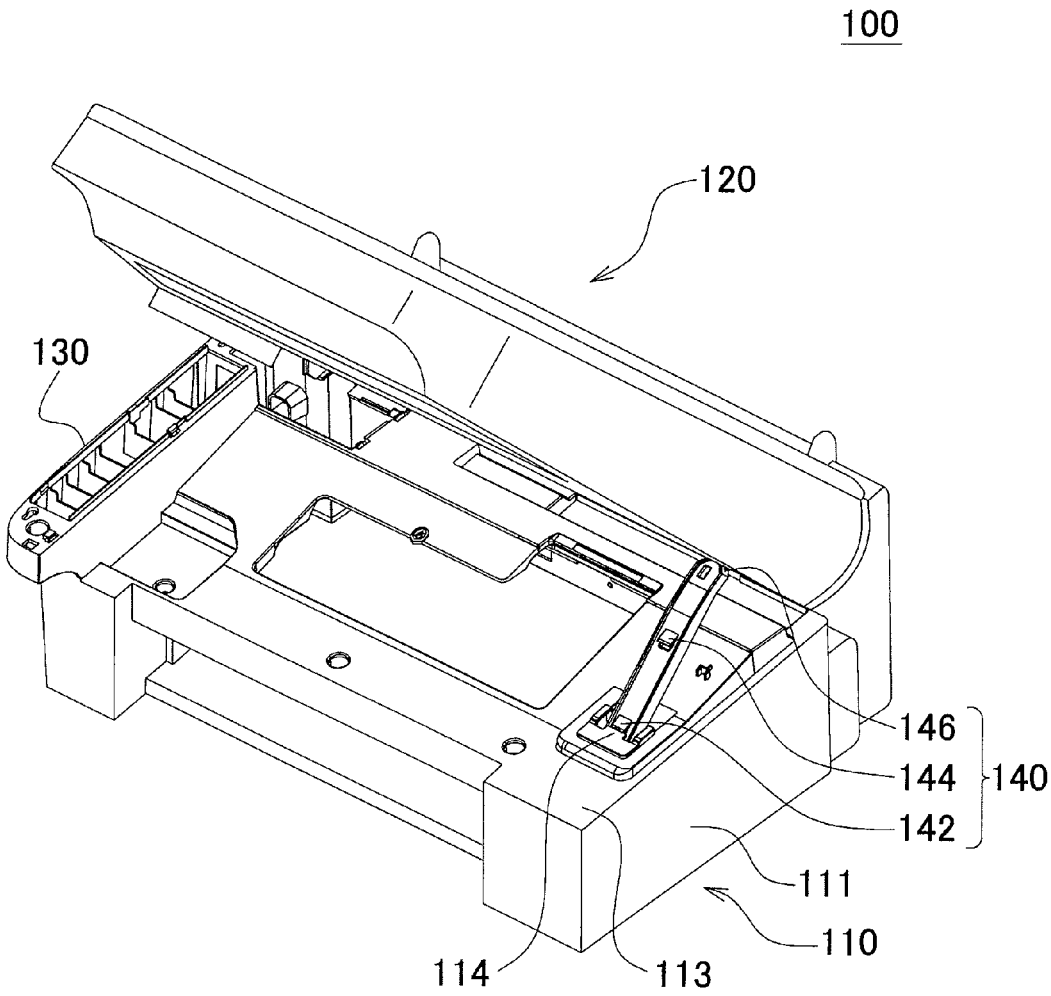
FIG. 3 is a perspective view of the image reading/recording apparatus 100 when the reading unit 120 is open.

FIG. 3 is a perspective view of the image reading/recording apparatus 100 when the reading unit 120 is in an opened state. When the reading unit 120 is fully opened, the recording unit 110 and the reading unit 120 form an angle therebetween of approximately 50 degrees.

The front edge of the reading unit 120 is lifted with the back edge of the pivot member 126 as an axis, but the operation panel 130 remains behind. In this way, the counterface surface 113, which is the upper surface of the lower chassis 111 and faces the reading unit 120, is exposed. The counterface surface 113 has an aperture in the substantial center thereof, through which internal mechanisms of the recording unit 110 can be accessed. A support member 140 is positioned between the recording unit 110 and the reading unit 120, and supports the reading unit 120 at an angle as described below.

Figure 4:
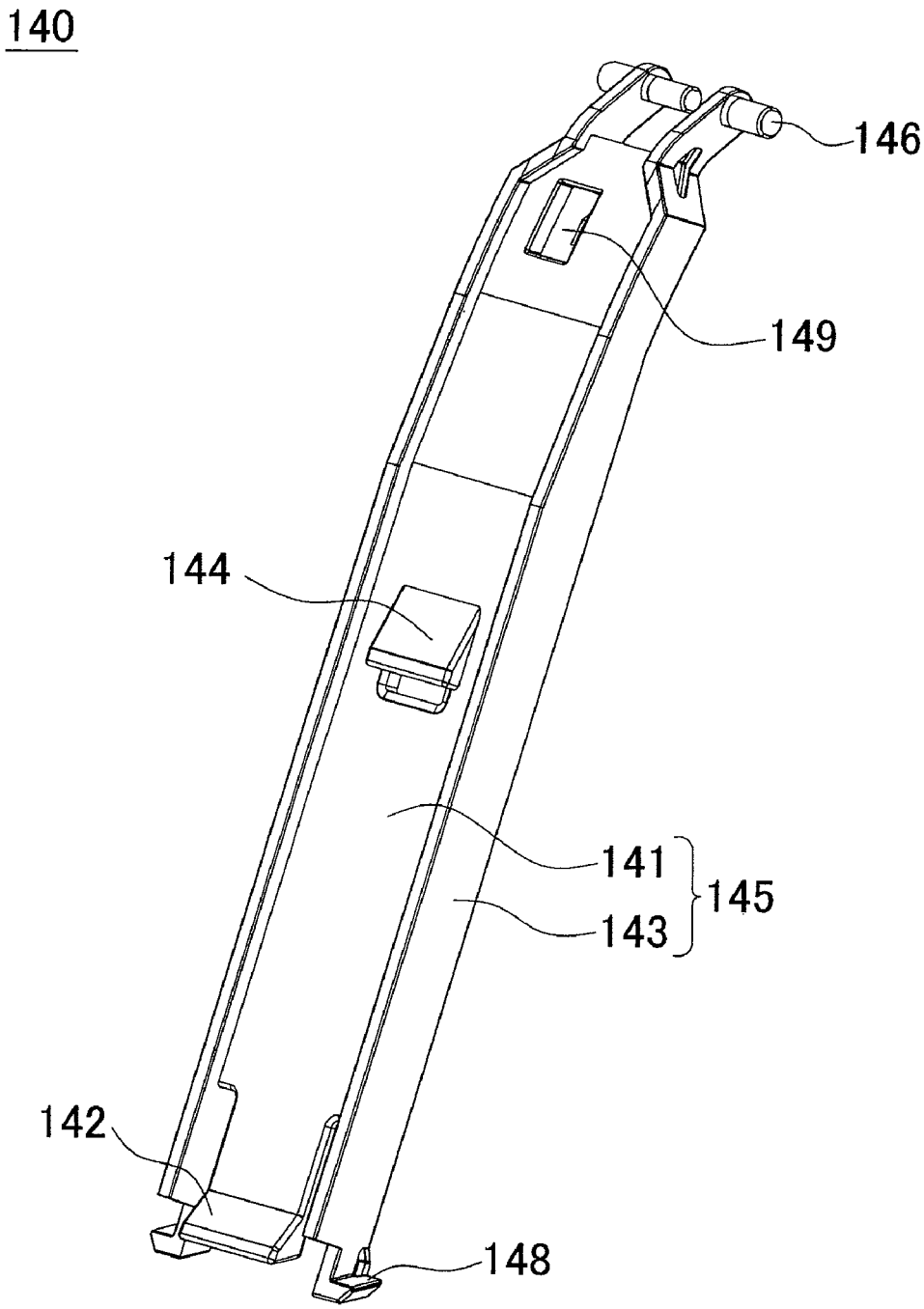
FIG. 4 is a perspective view of the support member 140 by itself.

FIG. 4 is a perspective view of the support member 140 by itself. A support column 145 has high bending rigidity, and includes a support column body 141 shaped as a long and thin board and a pair of reinforcing ribs 143 formed on both sides of the support column body 141.

A connecting portion 146 includes a pair of short axles arranged along the same axis and formed on the upper tip of the support column 145. The connecting portion 146 is supported by an axel receiving portion formed on the bottom of the reading unit 120. In this way, the support column 145 is joined pivotally to the reading unit 120.

A contact portion 142 is formed at the bottom tip of the support column 145 to protrude from the support column body 141. The contact portion 142 has a top surface with a gentle incline relative to the front surface of the support column body 141, and a bottom surface that is substantially perpendicular to the front surface of the support column body 141.

A central contact portion 144 is formed in the approximate length-wise middle of the support column 145 to protrude from the support column body 141. The central contact portion 144 has a top surface with a gentle incline relative to the front surface of the support column body 141, and a bottom surface that is substantially perpendicular to the front surface of the support column body 141.

The support member 140 further includes lateral protrusions 148 and a biased member receptacle 149. The lateral protrusions 148 are formed as a pair on the sides of the contact portion 142, and protrude from the side to extend beyond the reinforcing ribs 143. The biased member receptacle 149 is formed near the connecting portion 146, and receives an edge of the biased member whose other edge contacts the reading unit 120.

The biased member presses the support column body 141 from behind, to bias the bottom tip of the pivoting support column 145 in a forward direction. The biased member may be provided as an independent elastic member, or may be formed integrally as a portion of the support member 140 or the upper chassis 121.

Figure 5:
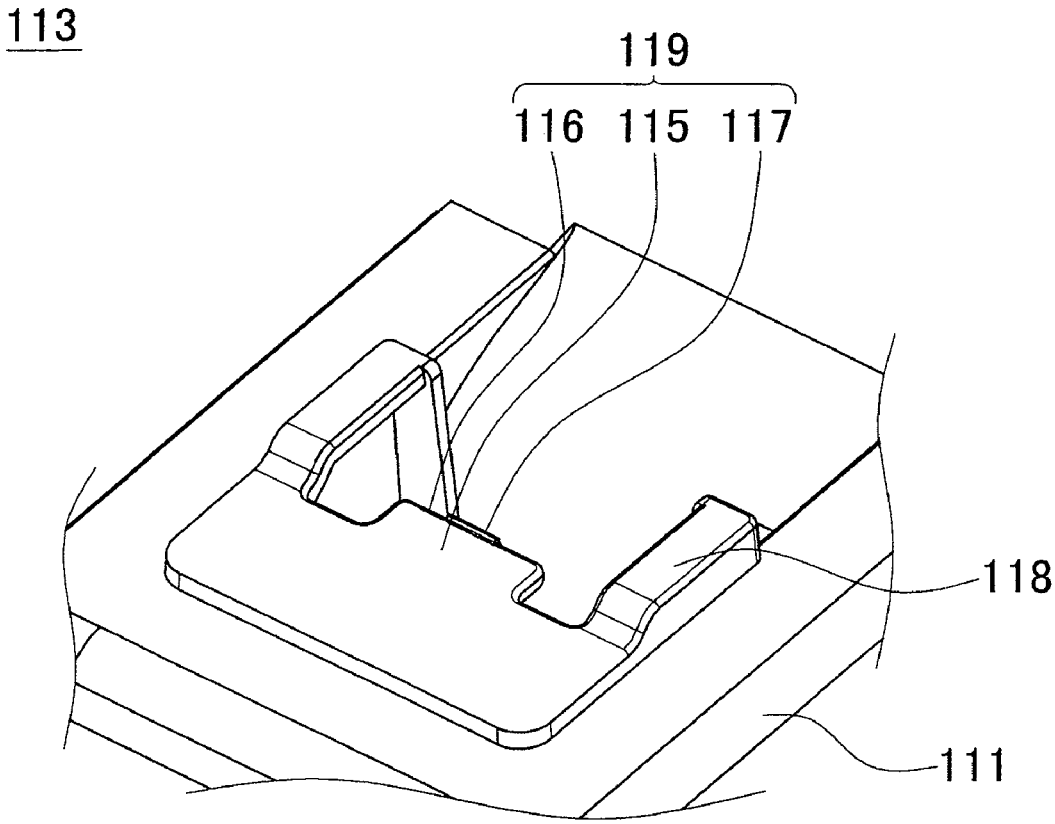
FIG. 5 is a partial perspective view of the magnified stopping portion 119.

FIG. 5 is a partial magnified view of the region contacting the contact portion 142 in FIG. 3. A stopping portion 119 is formed in the region of the counterface surface 113 contacting the contact portion 142.

The stopping portion 119 is formed on the anterior border of the aperture formed in the counterface surface 113, and includes a contact surface 115, retreated portions 116, and a fastening claw 117. The contact surface 115 has a substantially horizontal surface that contacts the bottom surface of the contact portion 142. A pair of retreated portions 116 are formed on both sides of the posterior border of the contact surface 115. The fastening claw 117 protrudes upward from the back edge of the contact surface 115.

The counterface surface 113 has a pair of guiding portions 118 on both edges of the aperture. Each guiding portion 118 has a horizontal surface that extends backward from the stopping portion 119 and a perpendicular surface that extends downward from the back edge of the horizontal surface.

Figure 6A:
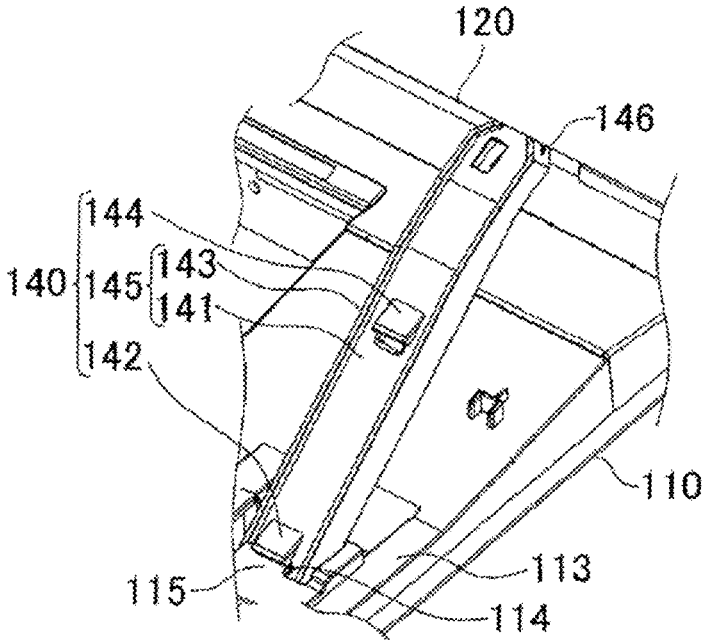
FIG. 6 shows the contact portion 142 and the stopping portion 119 in an engaged state.
Figure 6B:
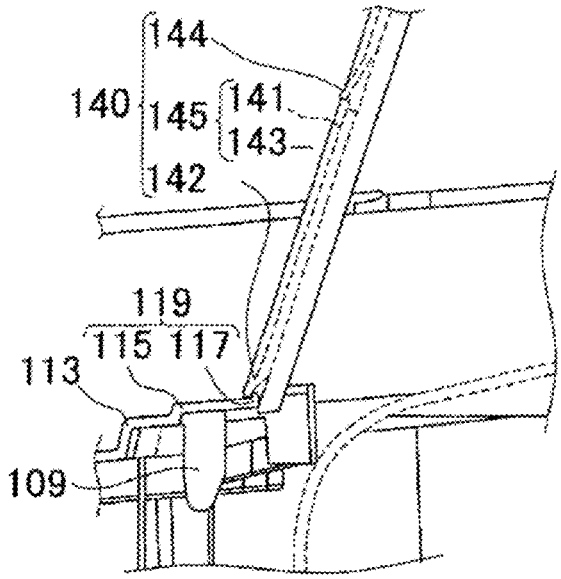

FIGS. 6A and 6B show the region around the support member 140 of the image reading/recording apparatus 100 in the state described in FIG. 3. FIG. 6A is a magnified view of the region around the support member 140. The support member 140 includes the connecting portion 146, the support column 145, the contact portion 142, and the central contact portion 144.

The connecting portion 146 is located on the upper tip of the support member 140, and is joined to the bottom of the reading unit 120. The contact portion 142 is formed at substantially the bottom tip of the support member 140 and contacts the counterface surface 113. The support column 145 joins the connecting portion 146 to the contact portion 142 while maintaining a constant space therebetween. The central contact portion 144 is located at the approximate center of the support column 145.

FIG. 6B is a cross-sectional view of the image reading/recording apparatus 100 in the state shown in FIG. 3 while the contact portion 142 and the stopping portion 119 are engaged. When the contact portion 142 contacts the contact surface 115, the back edge of the contact surface 115 contacts the support column body 141. In this way, the displacement of the support column 145 in a forward direction can be stopped.

The support member 140 may include a portion that extends further downward than the contact portion 142 to stop the forward displacement of the contact portion 142 by contacting the border of the contact surface 115 when the contact portion 142 contacts the contact surface 115 of the counterface surface 113. In this way, the support member 140 can safely support the raised reading unit 120.

The fastening claw 117 may be inserted into the bottom of the contact portion 142, thereby stopping the backward displacement of the contact portion 142.

A guiding protrusion 109 protruding in a downward direction is formed on the inner surface of the contact surface 115. The purpose of the guiding protrusion 109 is described in detail with reference to FIG. 11B.

In the manner described above, the image reading/recording apparatus 100 is formed to hold the front edge of the reading unit 120 at a certain distance from the recording unit 110, by being provided with the recording unit 110, the reading unit 120 whose back edge is connected to the recording unit 110 via the pivot member 126, the support member 140 having (i) the connecting portion 146 that is connected pivotally to the reading unit 120, (ii) the contact portion 142 that contacts the counterface surface 113 of the recording unit 110 facing the reading unit 120, and (iii) the support column 145 that positions the contact portion 142 at a position a certain distance from the connecting portion 146, the biased member that is biased against the support member 140 in a forward direction, and the stopping portion 119 formed on the counterface surface 113 to stop the contact portion 142 contacting the counterface surface 113 from being displaced along the counterface surface 113. In this way, an image reading/recording apparatus 100 with a simple structure can be formed that can support the opened reading unit 120 without obstructing opening of the reading unit 120.

Figure 7:
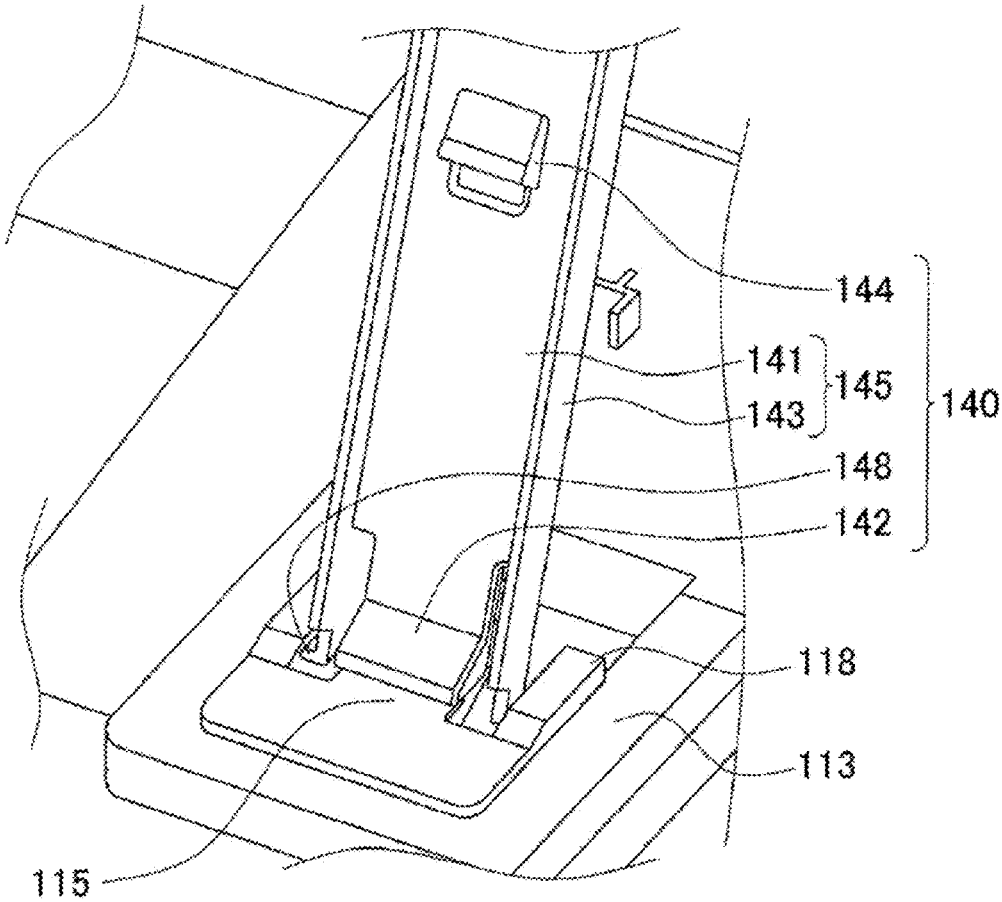
FIG. 7 is a perspective view of the contact portion 142 and the stopping portion 119 in an engaged state.

FIG. 7 is a perspective view of the contact portion 142 inserted into the stopping portion 119 when the reading unit 120 is in the opened state. The bottom of the contact portion 142 contacts the contact surface 115 to support the reading unit 120 via the support column 145. The reinforcing ribs 143 of the support column 145 are inserted into the retreated portion 116. The lateral protrusions 148 are positioned on the inside of the guiding portions 118.

Figure 8A:
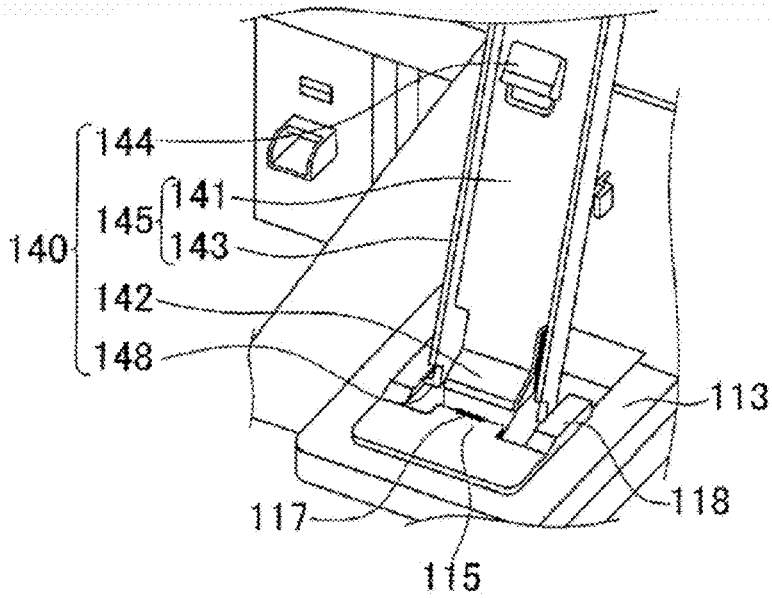
FIG. 8 shows the function of the guiding portions 118 and the lateral protrusions 148.
Figure 8B:
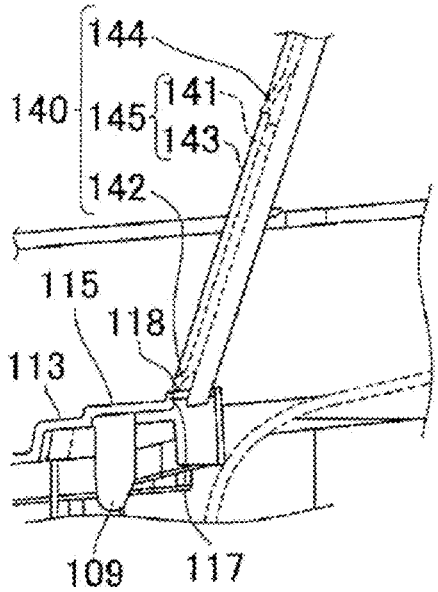

FIGS. 8A and 8B show the region around the support member 140 of the image reading/recording apparatus 100 when the reading unit 120 is raised slightly from the state shown in FIG. 3. FIG. 8A shows the functions of the guiding portions 118 and the lateral protrusions 148. When the reading unit 120 is raised, the support member 140 is also raised via the connecting portion 146, so that the lateral protrusions 148 move backward along the horizontal surface of the guiding portions 118 after contacting this surface.

The lateral protrusions 148 moving backward eventually contact the perpendicular surface of the guiding portions 118. In this way, the displacement of the support member 140 is controlled so that the reading unit 120 is not opened too far.

FIG. 8B is a cross-sectional view of the functions of the guiding portions 118 and the lateral protrusions 148 in the same state as shown in FIG. 8A. When the support member 140 is raised along with the reading unit 120, the lateral protrusions 148 move along the guiding portions 118, and therefore the bottom tip of the support member 140 moves backwards against the bias of the biased member. As a result, the contact portion 142 separates from the fastening claw 117 so that the support member 140 can be displaced backwards. This allows stable support by the support member 140 and easy removal of this support with a simple structure.

When the reading unit 120 falls freely, the support member 140 exerts a bias in a direction from backwards to forwards, so that the contact portion 142 moves again until the bottom of the contact portion 142 contacts the contact surface 115. In this way, the reading unit 120 can again be held in the opened state.

On the other hand, when the user lowers the reading unit 120 by pressing down on the support member 140 against the bias of the biased member while in the state shown in FIG. 8B, the bottom tip of the support member 140 passes through the aperture of the counterface surface 113 so that the reading unit 120 can be closed. When the user closes the reading unit 120 in this way, the fastening claw 117 is already separated by the lateral protrusions 148 and the guiding portions 118, so that the support member 140 can be lowered smoothly. When raising the reading unit 120, the support member 140 is moved backwards by the lateral protrusions 148 and the guiding portions 118, such that the method for manipulating the support member 140 described above feels natural to the user.

As described above, the image reading/recording apparatus 100 may be provided with guiding portions 118 that distance the contact portion 142 from the counterface surface 113 when the support member 140 is pushed forward. In this way, the manipulation of the support member 140 when closing the reading unit 120 is smooth and simple.

As described above, when lowering the reading unit 120 while pushing the support member 140 downward from a state where the reading unit 120 is raised slightly beyond a fully opened state, the reading unit 120 can be closed without being affected by the support member 140. However, when the reading unit 120, which is high-precision equipment, is lowered quickly from a fully opened state to a fully closed state, the equipment might be damaged by the resulting shock. Therefore, the support member 140 prevents the reading unit 120 from falling quickly by controlling the fall of the reading unit 120 again at a position midway between the fully opened state and the fully closed state.

Figure 9A:
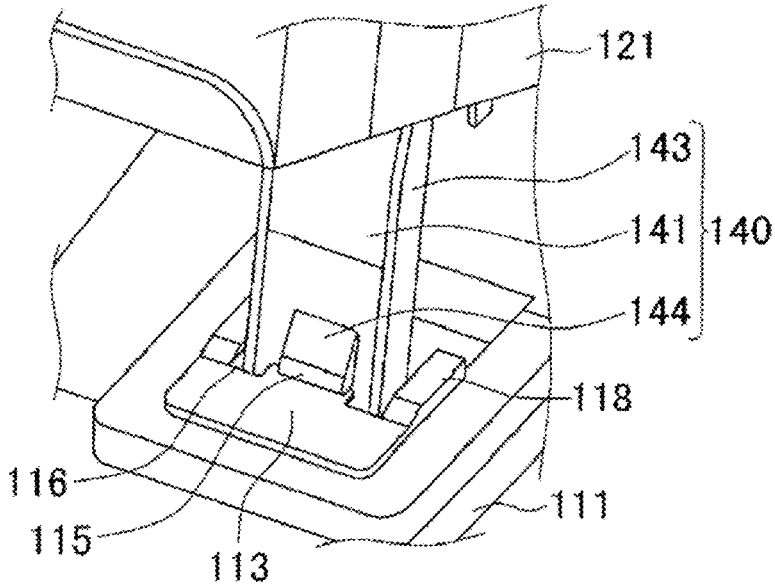
FIG. 9 shows the central contact portion 144 and the stopping portion 119 in an engaged state.
Figure 9B:
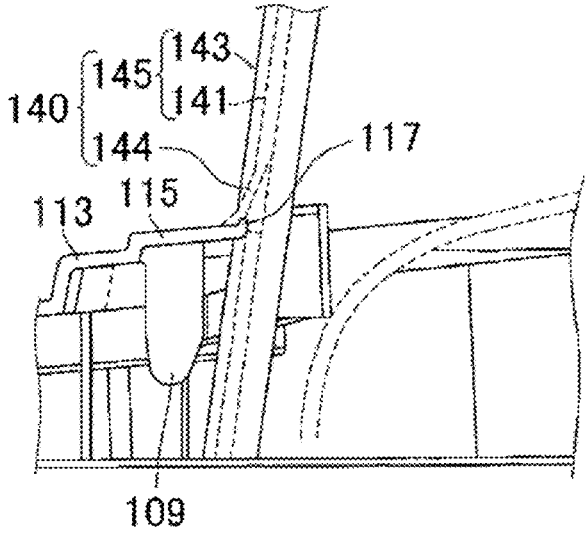

FIGS. 9A and 9B show the region around the support member 140 of the image reading/recording apparatus 100 when the reading unit 120 is lowered from the state shown in FIGS. 8A and 8B. FIG. 9A shows a state where the central contact portion 144 is engaged with the stopping portion 119. The bottom of the central contact portion 144 contacts the contact surface 115 to support the reading unit 120 via the support column 145. The reinforcing ribs 143 of the support column 145 are inserted into the retreated portions 116. A portion of the support member 140 that is lower than the central contact portion 144 passes through the aperture of the counterface surface 113 to reach the inside of the lower chassis 111.

FIG. 9B is a cross-sectional view of a state where the central contact portion 144 is engaged with the stopping portion 119. When the central contact portion 144 contacts the contact surface 115, the back edge of the contact surface 115 contacts the support column body 141 directly beneath the central contact portion 144, thereby stopping the forward displacement of the support column 145. Furthermore, the fastening claw 117 is inserted into the bottom of the central contact portion 144, thereby stopping the backward displacement of the central contact portion 144.

As described above, the support member 140 is biased in a forward direction. Accordingly, in the middle of the fall of the reading unit 120, the central contact portion 144 contacts the contact surface 115 to stop the reading unit 120 from falling any further, unless the user intentionally presses down on the support member 140. In this way, the reading unit 120 is prevented from quickly falling from the fully opened state.

On the other hand, a user that continues to press down on the support member 140 is aware that the reading unit 120 is being lowered, and therefore the user, by supporting the reading unit 120 or the like, makes sure the reading unit 120 does not fall too quickly. The support member 140 being pressed does not interfere with the fall of the reading unit 120, so that the reading unit 120 can be lowered smoothly.

The support member 140 may include the central contact portion 144 arranged along the support column 145 between the connecting portion 146 and the contact portion 142. As a result, when the reading unit 120 falls, the reading unit 120 can be supported at a mid-point of the fall to be prevented from falling too quickly.

When the front edge of the reading unit 120 falls toward the recording unit 110, the support member 140 may move into the recording unit 110. This prevents the overall area occupied by the image reading/recording apparatus 100 from increasing.

Figure 10:
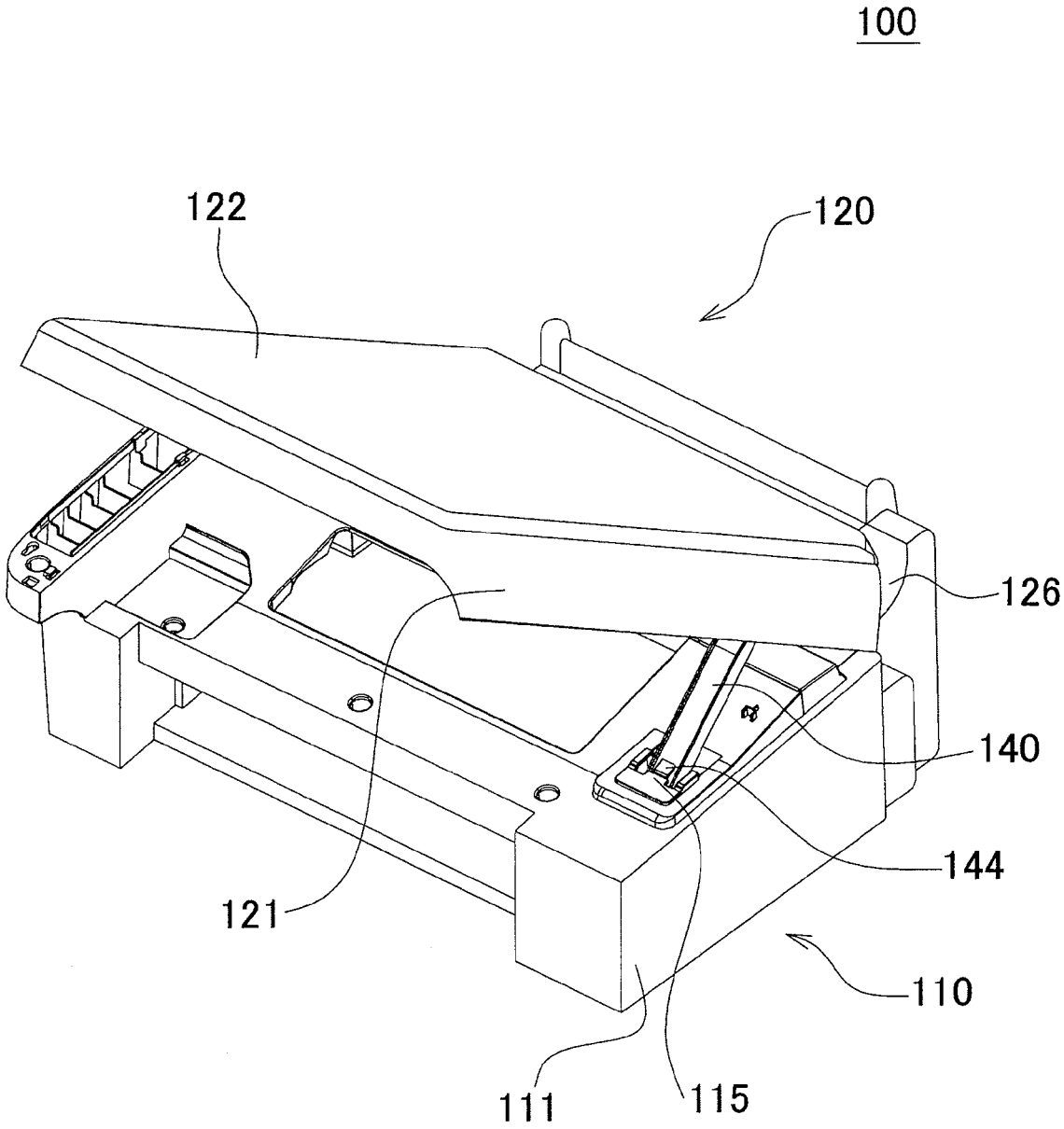
FIG. 10 is a perspective view of the image reading/recording apparatus 100 in a half-closed state.

FIG. 10 is a perspective view of the image reading/recording apparatus 100 in a half-closed state where the reading unit 120 is supported at the mid-point position. When the reading unit 120 is in the half-closed state, the recording unit 110 and the reading unit 120 form an angle of approximately 25 degrees.

The front edge of the reading unit 120 opens with the back edge of the pivot member 126 serving as a pivoting axis, thereby exposing the counterface surface 113 in the recording unit 110. The region around the bottom tip of the support member 140 is inserted into the aperture of the counterface surface 113, allowing the central contact portion 144 to contact the contact surface 115. In this way, the support member 140 can support the reading unit 120 at the mid-point position.

Figure 11A:
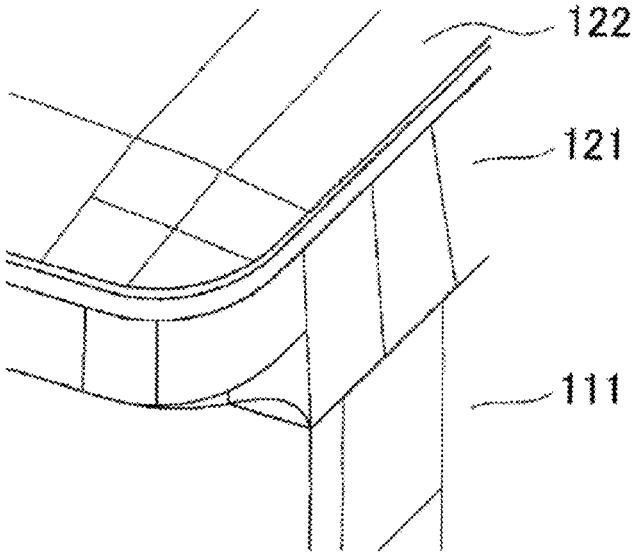
FIG. 11 shows the image reading/recording apparatus 100 when the reading unit 120 is closed.
Figure 11B:
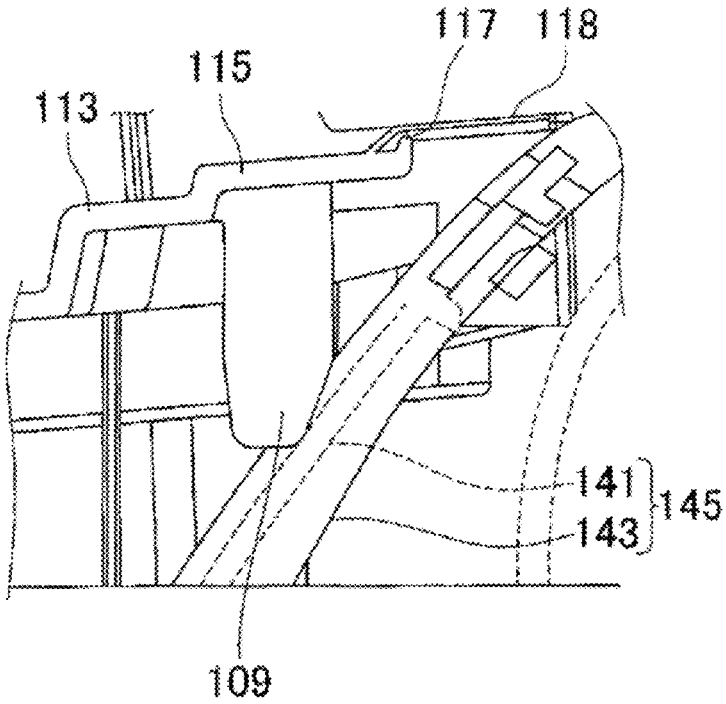

FIGS. 11A and 11B show the image reading/recording apparatus 100 in a closed state where the reading unit 120 is completely lowered. FIG. 11A shows a portion of the image reading/recording apparatus 100 when the reading unit 120 is closed. When the reading unit 120 is completely closed, the bottom of the reading unit 120 closely contacts the counterface surface 113. In this way, the reading unit 120 is directly supported by the lower chassis 111.

FIG. 11B is a partial cross-sectional view of the region around the stopping portion 119 when the reading unit 120 is closed. Almost the entire support member 140 is inside of the recording unit 110, so as not to interfere with the close contact between the upper chassis 121 and the lower chassis 111.

The guiding protrusion 109 is formed on the inner surface of the contact surface 115 to extend downward. The bottom edge of the guiding protrusion 109 contacts the support column body 141 of the support member 140 that has entered into the lower chassis 111, to be almost perpendicular to the orientation of the support member 140. In this way, when opening the reading unit 120, the bias force on the support member 140 is prevented from exerting a force in a direction that interferes with the raising of the reading unit 120, so that the reading unit 120 can be raised smoothly.

As described above, the tops of the central contact portion 144 and the contact portion 142 have gentle inclines relative to the support column body 141. Accordingly, when opening the reading unit 120, the support member 140 automatically retracts when the tops of the central contact portion 144 and the contact portion 142 are pressed down by the back edge of the contact surface 115, so that the support member 140 does not interfere with the raising of the reading unit 120.

In the above embodiment, the words "up" and "down" refer to the relative directions when the chassis of the layered structure are stacked. When the upper structure and the lower structure pivot around a pivoting axis, the side that opens is referred to as the "front" and the side having the pivoting axis is referred to as the "back." However, when forming a layered structure in which the distance between the upper structure and the lower structure can be changed, the member serving as the pivoting axis might not be necessary. Accordingly, when changing the distance between the upper structure and the lower structure from a short distance to a large distance, "front" refers to the side with a longer separation distance and "back" refers to the side with a shorter separation distance.

While the embodiment of the present invention has been described, the technical scope of the invention is not limited to the above described embodiment. It is apparent to persons skilled in the art that various alterations and improvements can be added to the above-described embodiment. It is also apparent from the scope of the claims that the embodiments added with such alterations or improvements can be included in the technical scope of the invention.

What is claimed is:

1. An image reading and recording apparatus, comprising:

a lower chassis;

an upper chassis joined to the lower chassis via a pivot member;

a support member having (i) a connecting portion that is connected pivotally to the upper chassis when the upper chassis is pivoted apart from the lower chassis by the pivot member, (ii) a contact portion adapted to contact a counterface surface of the lower chassis facing the upper chassis, and (iii) a support column that positions the contact portion at a position a certain distance from the connecting portion such that a front edge of the upper chassis is held at a certain distance from the lower chassis, wherein, when the upper chassis is pivoted apart from the lower chassis by the pivot member, the support member enters inside of the lower chassis when the front edge of the upper chassis falls toward the lower chassis;

a biased member that biases the support member in a forward direction with the connecting portion as an axis; and a stopping portion that is provided on the counterface surface and stops the contact portion from being displaced in a forward direction along the counterface surface when the contact portion contacts the counterface surface.

2. The image reading and recording apparatus according to claim 1, wherein the stopping portion includes a portion that extends above a bottom edge of the support member to stop the displacement of the contact portion in the forward direction by contacting the support member.

3. The image reading and recording apparatus according to claim 1, wherein the support member includes a portion that extends below the contact portion to stop the displacement of the contact portion in the forward direction by contacting a border of the counterface surface when the contact portion contacts the counterface surface.

4. The image reading and recording apparatus according to claim 1, wherein the support member further includes a central contact portion that is positioned between the connecting portion and the contact portion along the support column and that stops displacement of the central contact portion in the forward direction and the downward direction when the central contact portion contacts the counterface surface.

5. The image reading and recording apparatus according to claim 3, wherein the stopping portion includes a fastening claw that protrudes in an upward direction from the counterface surface to engage with the contact portion and stop displacement of the contact portion in the backward direction.

6. The image reading and recording apparatus according to claim 5, wherein the fastening claw is disengaged by moving the support member in the upward direction, thereby allowing the support member to be displaced in the backward direction.

7. The image reading and recording apparatus according to claim 1, wherein the contact portion is operable to contact the counterface surface when the upper chassis is pivoted apart from the lower chassis by the pivot member and to not contact the counterface surface when the front edge of the upper chassis falls toward the lower chassis.

* * * * *